US005600878A

United States Patent [19]

Byrne et al.

[11] Patent Number: 5,600,878

[45] Date of Patent: Feb. 11, 1997

[54] MANDREL STEM LENGTH MEASUREMENT SYSTEM FOR USE WITH BLIND RIVET SETTING TOOL

[75] Inventors: Darren S. Byrne, Naugatuck; William E. O'Connor, Waterton, both of Conn.

[73] Assignee: Emhart Inc., Newark, Del.

[21] Appl. No.: 426,077

[22] Filed: Apr. 20, 1995

[51] Int. Cl.[6] ..... B21J 15/28

[52] U.S. Cl. ..... 29/243.525

[58] Field of Search ..... 29/243.521, 243.523, 29/243.525; 72/391.4

[56] References Cited

U.S. PATENT DOCUMENTS

| | | | |
|---|---|---|---|
| 4,836,003 | 6/1989 | Blake | 29/243.525 |
| 5,035,129 | 7/1991 | Denham et al. | 29/243.523 |
| 5,035,353 | 7/1991 | Smart et al. | 29/243.523 |

FOREIGN PATENT DOCUMENTS

| | | | |
|---|---|---|---|
| 2188860 | 10/1987 | United Kingdom | 29/243.523 |

*Primary Examiner*—David Jones
*Attorney, Agent, or Firm*—E. Murphy

[57] ABSTRACT

A blind rivet set verification system for setting a blind rivet and assessing the acceptability of the rivet set by measuring and comparing the length of the spent mandrel stem. The system includes a rivet setting apparatus and a programmed system control circuit. The apparatus includes a rivet setting tool, a mandrel stem collection box, and a collection tube connecting the tool and the box. The spent mandrel stems pass from the rivet tool to the collection box through the tube. Along the collection tube are provided a pair of sensors. The sensors are positioned in relatively close proximity to each other and to the box and provide the control circuit with information required to identify and compare mandrel stem length.

28 Claims, 4 Drawing Sheets

MANDREL STEM LENGTH MEASUREMENT SYSTEM FOR USE WITH BLIND RIVET SETTING TOOL

BACKGROUND OF THE INVENTION

1. Technical Field

This invention relates to the setting of blind rivets. More particularly, this invention relates to a blind rivet setting system in which a blind rivet is first set and then the correctness of the breaking point of the mandrel stem is verified.

2. Discussion

Rivets are widely used to firmly fasten together two or more components of little susceptibility to loosening and thus to produce a tight joint at a low cost.

The setting of the common rivet is accomplished when one end of the rivet is mechanically deformed to create a second head. The blind rivet is a special class of rivet that can be set without the need for mechanical deformation by a separate tool to create the second head. Special blind rivet setting tools are used for setting these types of rivets. Examples of setting tools may be found in U.S. Pat. No. 3,713,321 issued on Jan. 30, 1973 to Gabriel for RIVET GUN, U.S. Pat. No. 3,828,603 issued on Aug. 13, 1974 to (Scheffield) et al. for riveting apparatus, and U.S. Pat. No. 4,263,801 issued on Apr. 28, 1981 to Gregory for HYDRAULIC RIVETER. These tools provide various approaches to setting rivets including setting by hydraulic and pneumatic power.

A relatively sophisticated version of a blind rivet setting tool is disclosed in U.S. Pat. No. 4,744,238 issued on May 17, 1988 to Halbert for PNEUMATIC RIVET SETTING TOOL. This setting tool includes a rivet feed mechanism, a rivet magazine and sequencing controls providing cycle-through operation that utilizes pneumatic logic control. A self-diagnosing blind rivet tool is disclosed in U.S. Pat. No. 4,754,643 issued on Jul. 5, 1988 to Weeks, Jr. et al. for METHOD AND APPARATUS FOR AUTOMATICALLY INSTALLING MANDREL RIVETS. This patent is directed to an automated and semi-automated rivet installation system that has the ability to diagnose selected tool conditions and to convey information on the conditions to the operator. Monitored conditions include the rivet placement within the tool, mechanism positions, and air pressure conditions.

While the prior art apparatus have overcome some of the difficulties inherent in the setting of blind rivets, a remaining difficulty common in the setting of blind rivets has to do with the mandrel and its associated stem. The blind rivet conventionally includes a frangible tubular body and an elongated mandrel. The mandrel includes an enlarged head and a stem extending rearwardly of the head through the frangible tubular body. A weakened area is selectively formed along the length of the mandrel stem so as to provide a breaking point. When the rivet setting tool pulls on the mandrel stem, the stem is intended to break from the mandrel head at this preselected weakened point, thereby assuring that the tubular body is correctly deformed and the rivet properly set. If the mandrel stem does not break at this preselected point, the spent stem will be too short or too long. Either situation results in an incorrect rivet set.

Accordingly, knowledge concerning the length of a particular spent stem would provide the operator with useful information about the correctness of the rivet set. However, while stem length is an important characteristic in assuring a correctly set rivet, measurement of the spent stem is not a simple task. Unless the length is so improper as to be plainly obvious, simple visual analysis is virtually useless in that even a relatively minor variation in stem length from the predetermined ideal length could result in an improperly set rivet. Actual measurement of each spent stem is thus required to assure a proper rivet set. However, it would be entirely impractical for the operator to physically measure each spent mandrel stem against an ideal length.

Accordingly, there is still a need for a system by which a blind rivet may be first set, the correctness of the mandrel stem breaking point be efficiently measured, and the actual length be compared against a predetermined desired length for set verification.

SUMMARY OF THE INVENTION

It is therefore an object of the present invention to overcome the disadvantages associated with known blind rivet setting tools by providing an improved rivet setting and correctness verification system.

A further object of the present invention is to provide a system that determines if a mandrel stem has broken from the mandrel head at the preferred break point.

Yet a further object of the present invention is to provide such a system which senses the beginning and the end of a passing mandrel stem.

Still another object of the present invention is to determine the velocity of the passing mandrel stem.

Yet still a further object of the present invention is to provide such a system where the length of the spent stem is determined by multiplying the determined velocity with the total "ON" time of one of the sensors, corrected for sensor hysteresis.

A further object of the present invention is to check the determined length by comparing the number of "ON" locations for each sensor so as to verify that the number of "ON" locations is the same.

The present invention achieves these and other objectives in an improved blind rivet set verification system that comprises a blind rivet setting apparatus and a programmed system control circuit.

The apparatus comprises a blind rivet setting tool, a mandrel stem collection box, and a collection tube connecting the tool and the collection box. The setting tool includes a rivet pulling head connected to a stem-passing channel integral with the tool body. The stem channel of the tool is connected to the collection tube. The spent mandrel stem is drawn by vacuum from the pulling head through the stem channel and the collection tube to the mandrel stem collection box.

Along the collection tube are provided a pair of sensors. The sensors are positioned in relatively close proximity to each other and to the collection box. The sensors provide the system control circuit with information required to make a determination as to the correctness of stem length.

In making the determination of the correctness of stem length, the control circuit first determines mandrel stem velocity by measuring the time interval between the leading edges of the two sensor signals. The velocity figure is used to obtain the length of the spent mandrel stem based on the time for the mandrel stem to pass one of the sensors. An optional double check of the determined length of the stem may be made when the control circuit goes through an identical calculation involving the other sensor. The system includes a notification component to inform the operator of the correctness of the mandrel length and hence the correctness of the rivet set.

BRIEF DESCRIPTION OF THE DRAWINGS

Additional objects and advantages of the present invention will become apparent from a reading of the following detailed description of the preferred embodiment which makes reference to the drawings of which.

DETAILED DESCRIPTION OF THE PREFERRED EMBODIMENT

Figure 1:
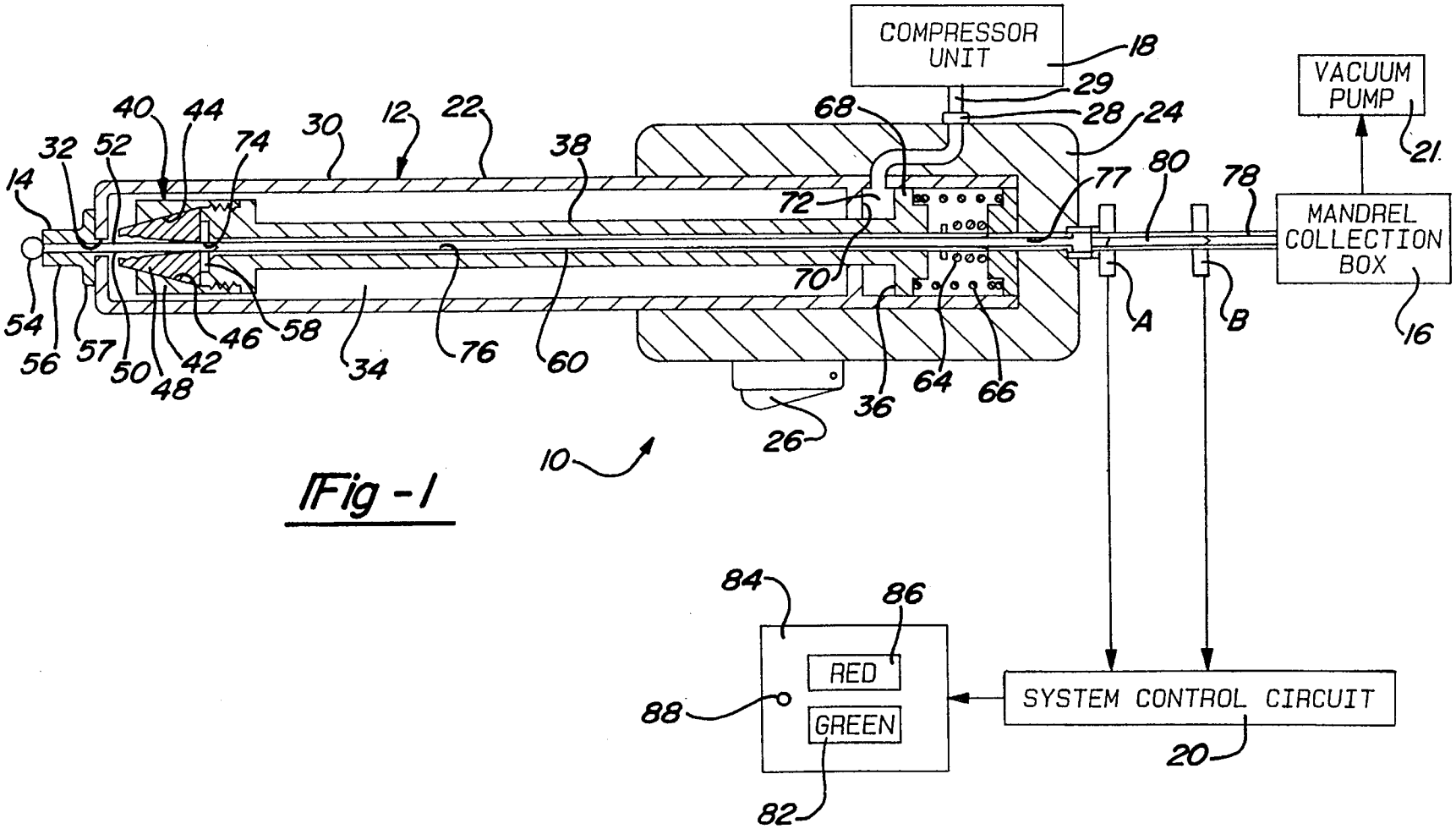
FIG. 1 is a combined pictorial and block diagram of the blind rivet setting apparatus according to the present invention showing the setting tool and spent mandrel stem collection tube in partial cross section.

Reference is first made to FIG. 1 wherein the system for setting blind rivets and for verifying the correctness of the mandrel stem breaking point according to the present invention is generally illustrated as 10. The system 10 generally includes a rivet mandrel pulling tool 12 for setting a blind rivet 14, a mandrel stem collection box 16 for receiving and holding spent rivet mandrels, and a pressure source 18 for providing compressed air to the tool 12, and a system control circuit 20. The mandrel stem collection box 16 includes or is associated with a vacuum pump 21 to create a negative pressure to the tool 12. Although the system 10 has been illustrated as having the mandrel collection box 16 remote from the tool 12, it is possible though not necessarily desirable that the collection box 16 be integrated with the tool 12.

The tool 12 comprises an elongated body generally illustrated as 22. While the body 22 may be of any of several constructions, it is preferably provided with a handle 24 as shown. A trigger 26 which actuates the tool 12 is fitted in the handle 24 in a conventional manner and is operatively associated with a valve 28. A fluid line 29 conventionally comprising a flexible hydraulic hose provides a source of operating positive pressure for the tool 12. The valve 28 allows the operator to selectively control the introduction of pressurized air into the tool 12 to thereby effect its operation.

The elongated body 22 includes an elongated housing 30. The housing 30 includes a mandrel stem-passing aperture 32 defined in its fore end. While not limited to this construction, the housing 30, as illustrated, is subdivided internally into a fore chamber 34 and a hydraulic cylinder chamber 36. The elongated body 22 includes an axially movable pulling shaft 38 provided along its long axis. It must be understood that the construction of the housing 30 may be varied in many ways, with its only essential feature being that it provide support for the pulling shaft 38 and for a means of axially moving the shaft.

A jaw assembly 40 is operatively associated with the fore end of the pulling shaft 38. The jaw assembly 40 includes a jaw cage 42 having an internal bevelled wedging surface 44 that defines an internal bore 46. An array of split jaws 48 are movably provided within the cage 42. When the outer surfaces of the split jaws 48 act against the bevelled wedging surface 44, the jaws 48 engage and grip an elongated stem 50 of a mandrel 52 of the blind rivet 14. The mandrel 52 also includes a rivet head 54. The mandrel 52 comprises the head deforming component of the rivet 14 as is known in the art. The rivet 14 includes a tubular deformable sleeve 56 and a flange 57. A variety of methods may be employed to manipulate the jaw assembly 40 to grasp and hold the stem 50 of the mandrel 52. While one such method is discussed hereafter, the various methods of construction of rivet setting tools are well known to those skilled in the art, and it is accordingly to be understood that the following construction is only illustrative and is not intended to be limiting.

According to the illustrated construction of the present invention, a pusher 58 is fixed to the forward end of a pusher rod 60. The pusher rod 60 is provided within a central throughbore defined in the pulling shaft 62. The pusher rod 60 is axially immovable within this throughbore and is biased at its aft end against the back wall of the hydraulic cylinder chamber 36 by a spring 64. A weaker spring 66 acts upon the same wall of the aft end of the pulling shaft 38. A piston 68 is fixed to the pulling shaft 38 and is capable of axial motion in both fore and aft directions within the hydraulic cylinder chamber 36. The pressure source 18 forces a pressurized fluid (not shown) through the fluid line 29 into the cylinder chamber 36 on the forward side of the piston 68 through a pressurized fluid port 70 into a pressurizable side 72 of the hydraulic cylinder chamber 36. By introducing a pressurized fluid into the fluid-tight chamber defined within the pressurizable side 72, the piston 68 is forced to move aftward causing the stem 50 to break from the head 54.

The pusher 58 includes a centrally-defined mandrel stem-passing aperture 74 through which the spent mandrel stem passes after the rivet is set. The pusher rod 60 has an axially-defined channel 76. The throughbore 76 is aligned with the mandrel stem-passing aperture 74. The aft end of the pusher rod 60 is axially movable through an aperture 77 defined in the handle 24. A collecting tube 78 connects the tool 12 with the collection box 16. One end of the tube 78 is secured to the aft end of the handle 24 while the other end is fitted to the box 16 such that the channel 76 is continuous with the mandrel collection box 16.

A pair of sensors A and B are provided in close, spaced part relation on the tube 78. Sensor B is positioned closely adjacent the box 16. The sensors A and B may be of a variety of types and may be proximity, photoelectric, or laser sensors, or may be of another type of sensor. The preferred type of sensor is one that is capable of optically sensing the passing of a spent mandrel stem, and, accordingly, the tube 78 may be completely or partially composed of a clear material.

In general, the sensors A and B provide the system control circuit 20 with the information required to make calculations necessary to determine whether or not the spent mandrel stem is of a correct length so as to determine the correctness of the rivet set. The general principal of the operation of the present invention is as follows. The sensors detect "ON" and "OFF" locations as a mandrel stem 80 passes. These signals are communicated to the system control circuit 20. By reliance upon an integral clock used to establish beginning ("ON") and ending ("OFF") times of each sensor signal, the circuit 20 determines the velocity of the spent mandrel stem 80 by measuring the time interval indicated by the sensor signals between the leading edges of the two sensors. The system control circuit 20 then utilizes the velocity figure to obtain length based on the time for the mandrel stem to pass through one of the sensors. As a way of a confirming check, an identical calculation involving the other sensor may be made. Because the sensors are positioned along the tube 78 close to the mandrel collection box 16 as noted above, it is safe to assume that the velocity of the spent mandrel stem 80 will remain reasonably constant during the short transition across the sensors.

Because the distance between the sensors is fixed and known by the computer, the velocity of the stem 80 is determined according to the following formula:

$$V=\frac{d}{T}$$

where:

V is the mandrel velocity d is the distance between sensors A and B

T is the time between sensor signal leading edges

In the determination of the length of the mandrel stem 80, the system control circuit 20 employs the total "ON" time of one of the sensors and the velocity determined from the calculation as set forth above. Because the "ON" time includes a component due to the inherent hysteresis of the sensor (this is much more significant in proximity sensors), the system control circuit 20 must subtract this time from the total "ON" time. The following formula shows the necessary compensating calculations:

$$L=V\,(t-h)$$

where:

L is the mandrel stem length

V is the mandrel stem velocity t is the total "ON" time of one of the sensors h is the component of time assignable to sensor hysteresis It is necessary to furnish the control circuit 20 with the value of sensor hysteresis as determined by either measurement or calculation from the sensor specifications.

Figure 2A:
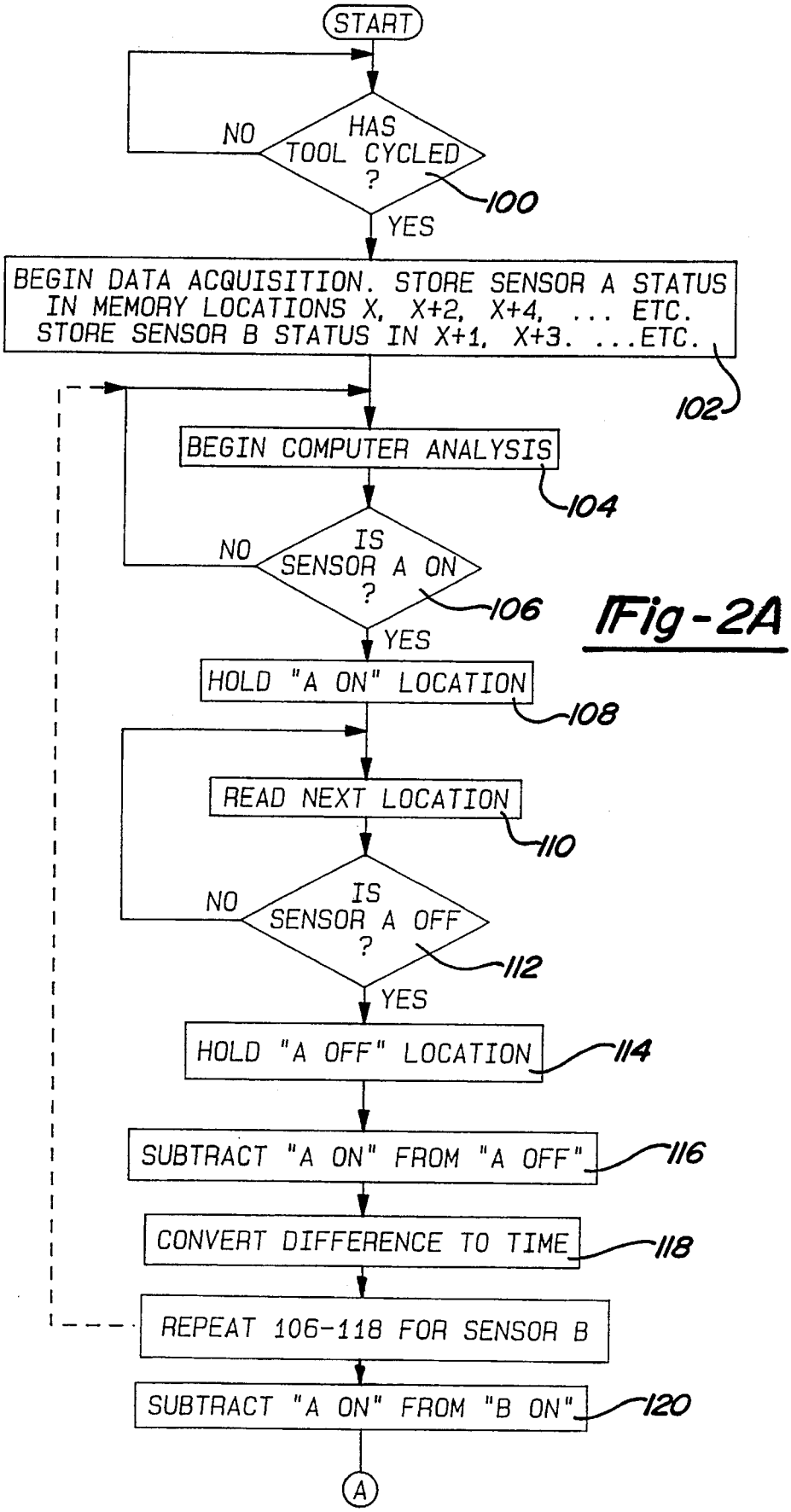
FIG. 2*a* is a first portion of a control flow chart of illustrative mandrel stem length analysis steps in accordance with the present invention.
Figure 2B:
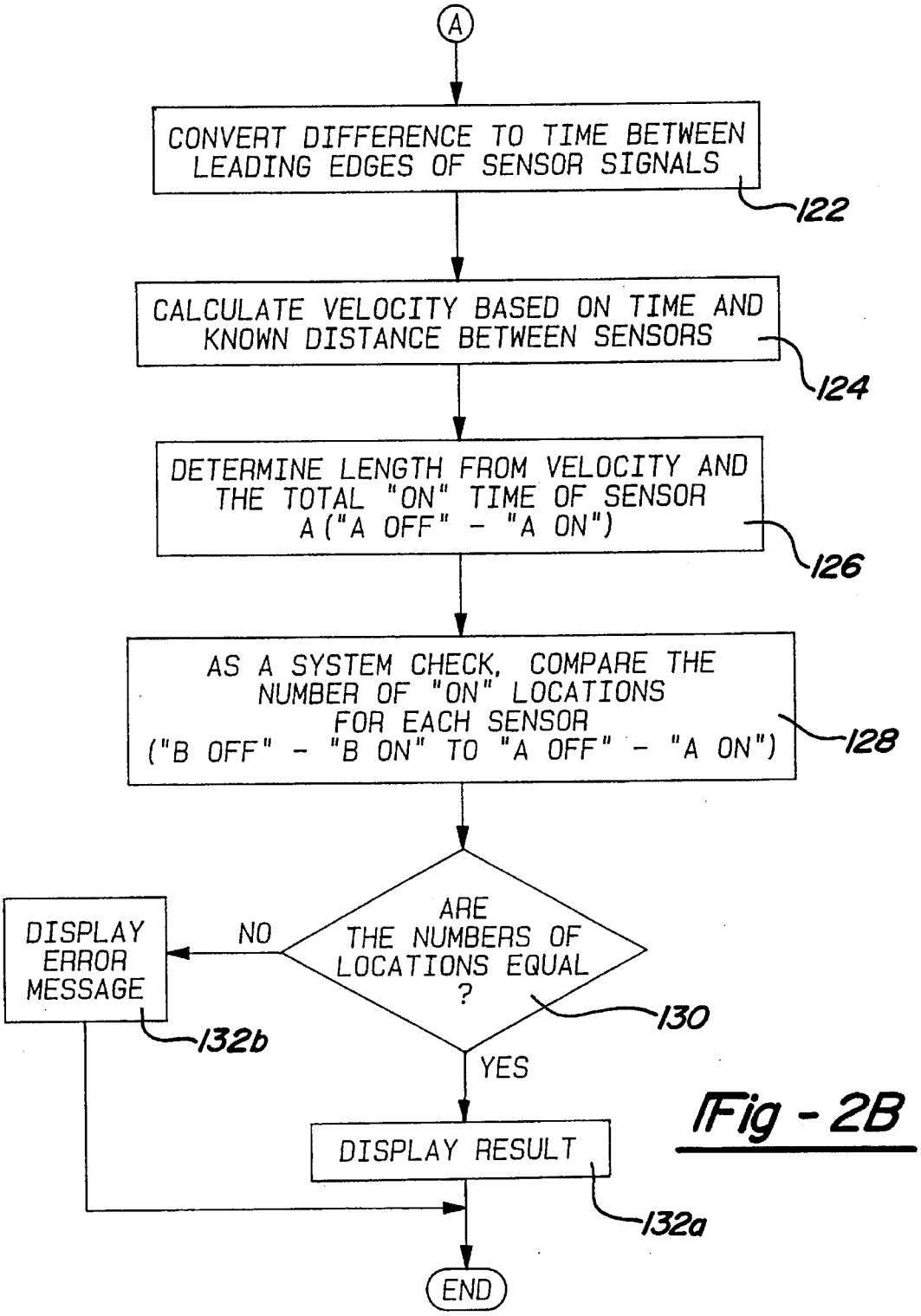
FIG. 2*b* is a second portion of the flow chart of FIG. 2*a;*.

The system control circuit 20 includes a programmed control algorithm to identify and analyze the length of the spent mandrel stem. The control algorithm used to analyze the mandrel stem length is described by reference to a mandrel length flow chart shown in FIGS. 2*a* and 2*b* in which an exemplary operation flow of the analysis is collectively set forth.

Operation of the tool 12 is initiated via actuation of the trigger 26. The control algorithm makes an initial query at Step 100 as to whether or not the tool 12 has, in fact, been operated. When it is found that the tool 12 has not been operated, the cycle is reset to the initial query at Step 100 until there is verification that the tool 12 has been operated.

Figure 3:
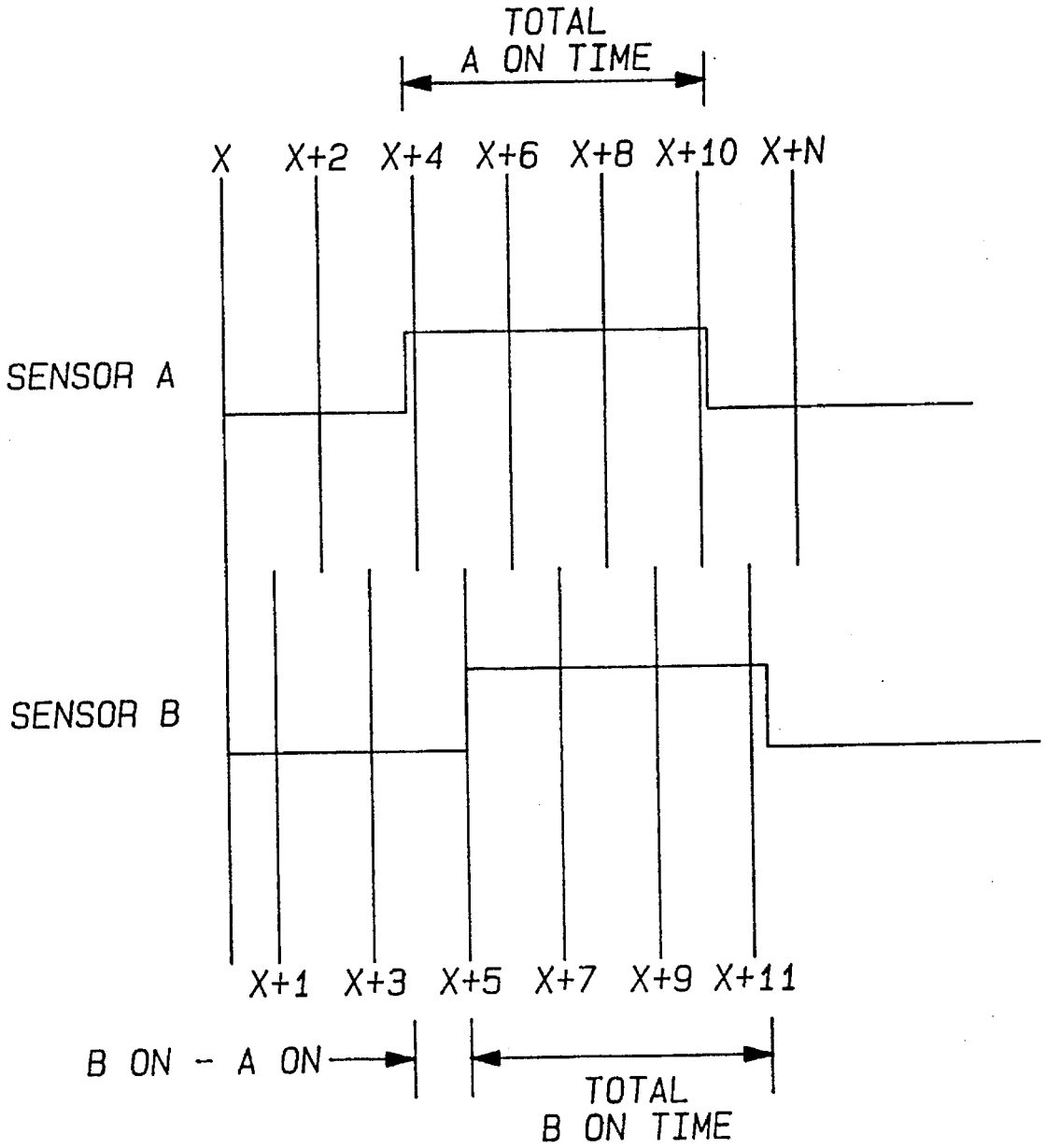
FIG. 3 is a graph illustrating a comparison of "ON" time for the sensors.

Once operation of the tool 12 has been verified, the algorithm collects status data from both sensors A and B at Step 102. Specifically, and as graphically illustrated in FIG. 3, data representing the status of sensor A are stored in memory locations x, x+2 . . . x+even n. Similarly, data representing the status of sensor B are stored in memory locations X+1 . . . X+odd n.

Once the data produced from sensors A and B are stored, computer analysis begins at Step 104. The initial query during computer analysis is made at Step 106 wherein operation of sensor A is checked. When it is found that the sensor A has not operated, the cycle is reset to the query at 106 until there is verification that the sensor A has been operated.

When there is verification that the sensor A has been operated, the algorithm stores the initial "ON" location for sensor A at Step 108. The algorithm then moves to Step 110 to read and hold the subsequent location for sensor A. Once the subsequent location is read, the algorithm moves forward to Step 112 where the query "Is Sensor A Off? " is made. If the sensor A is still reading "ON" locations, the cycle is reset to Step 110 to read the next "ON" location, and, once read, the algorithm again moves forward to Step 112. The cycle between Steps 110 and 112 is repeated until such time as it is determined in Step 112 that sensor A signals an "OFF" location. When this determination is made, the algorithm cycle proceeds to Step 114 at which point the "OFF" location of sensor A is stored.

The next step of the algorithm of the present invention is Step 116 at which the "ON" location of sensor A (stored in Step 108) is subtracted from the "OFF" location of sensor A (stored in Step 114). The algorithm next proceeds to Step 118 wherein the difference between the locations identified in FIG. 116 is converted to total "ON" time for sensor A.

Once the total "ON" time for sensor A is determined, the Steps 106 through 118 are repeated for sensor B to identify and store all of the "ON" locations and the "OFF" location. (While the total "ON" time for sensor B is not necessary for subsequent calculations required to determine stem length, a confirming analysis of the calculations may optionally be made by using the total "ON" time determined by sensor B to determine the actual stem length after the length calculation is made using the total "ON" time for sensor A as set forth below.)

The algorithm next moves to Step 120 wherein the initial "ON" location of sensor A is subtracted from the initial "ON" location of sensor B according to the formula $T_{Bon}-T_{Aon}$. In the next step, Step 122, the difference determined from Step 120 is converted to an interval of time between the leading edges of the sensors.

Thereafter, the algorithm proceeds to Step 124 where the velocity of the spent mandrel stem 80 is calculated by the system control circuit 20 according to the formula $$\frac{d}{T_{Bon}-T_{Aon}}$$

, where "d" represents the distance between the sensors A and B.

With the velocity thus determined, the algorithm then moves to Step 126 wherein the length of the spent mandrel stem 80 is calculated based upon the mandrel velocity determined in Step 124 and the time required for the spent mandrel 80 to pass through sensor A according to the formula $V(T_{Atotal}-T_h)$, where $T_{Atotal}$ is determined by subtracting the "ON" time of sensor A from the "OFF" time of sensor A according to the formula $T_{Aoff}-T_{Aon}$. Once the $T_{Atotal}$ is determined, it is corrected for hysteresis, as represented by the subtraction of $T_h$. As noted above, the total "ON" time includes an extra component due to the inherent hysteresis of the sensor. This extra component generally represents a lag between cause and effect such that the measured "ON" value, which represents an amount increased to a final value, is different from an amount that represents a decrease to the same final value. As the hysteresis of a given sensor is quantifiable, it is necessary to furnish the system control circuit 20 with the value of sensor hysteresis as determined by either measurement or calculation from the sensor specifications of the particular type of sensor used. Accordingly, the $T_{Atotal}$ is corrected by subtracting therefrom the known hysteresis as determined for the particular sensor. (In the event that the above-identified optional step of confirming the calculation is undertaken by recalculating length using the total "ON" time from sensor B, this total "ON" time is also corrected by compensating for hysteresis.)

Once the length of the spent mandrel stem 80 is known, the particular observed length may be reported to the operator by means of a digital indicator (not shown). As a preferred alternative, the observed length of the stem 80 is provided to a comparator circuit integrated with the system control circuit 20 which compares the actual stem mandrel length against an ideal stem length stored in a programmed reference for the particular type of rivet involved. If the actual observed length of the spent mandrel stem 80 is within predefined acceptable length ranges of the prestored values, a green light 82 on a visual display 84 is illuminated. If on the other hand the actual observed length of the spent mandrel stem 80 is outside the prescribed length range, a red light 86 is illuminated.

In addition to the digital and the green light-red light methods of correct stem length notification set forth above, a graph, such as a correct stem length-versus-incorrect stem length graph, may be produced in lieu of or in addition to these methods of operator notification. The form of the output would depend on the needs of the particular application.

Verification of the correct operation of the system 10 may be optionally made. At Step 128 the circuit 20 compares the number of "ON" locations produced for sensor A in Steps 106–114 against the number of "ON" locations produced for sensor B in similar subsequent steps. Once the numbers of "ON" locations of the two sensors are compared, the algorithm moves forward to Step 130 wherein inquiry is made of the equality of the numbers of locations. If the numbers of locations are equal, the algorithm proceeds to Step 132A wherein the green light 82 is illuminated. Conversely, if the comparison of the numbers of "ON" locations determines the numbers to be unequal, the algorithm proceeds to Step 132B, an error light 88 on the visual display 84 is illuminated. Following Step 132A or Step 132B, the algorithm then returns to start to await the next cycle.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

We claim:

1. A system for setting a blind rivet and for evaluating the acceptability of the set, the rivet being of the type having a frangible tubular body and an elongated mandrel that includes an enlarged head and a stem extending rearwardly of the head and through said frangible tubular body, said system comprising:

a blind rivet setting tool, said tool including a rivet pulling head for gripping and pulling said stem of said mandrel, said tool including a channel between said rivet pulling head and a point external of said tool for passage of the spent mandrel stem;

a mandrel stem collection box for receiving and holding spent mandrel stems;

a collection tube connecting said blind rivet setting tool and said mandrel stem collection box such that said spent stem passes from said blind rivet setting tool to said mandrel collection box through said collection tube;

a first sensor provided on said collection tube for sensing the bypassage of said mandrel stem, said first sensor being adapted to produce an output signal related to said bypassage of said stem;

a second sensor provided on said collection tube adjacent said first sensor for sensing the bypassage of said mandrel stem, said second sensor being adapted to produce an output signal related to said bypassage of said stem; and a control circuit associated with said sensors, said control circuit having circuitry to:

a) receive said output signal from said first sensor;

b) receive said output signal from said second sensor;

c) calculate the velocity of said bypassing stem from said output signals of said first and second sensors;

d) determine from one of said sensors the total time taken for said mandrel stem to pass said one of said sensors;

e) use the velocity and said determined total time to calculate the actual length of said stem;

f) compare said determined actual stem length of said mandrel stem with a predetermined desired length.

2. The system for setting a blind rivet of claim 1, wherein said output signals from said first and second sensors include "ON" location signals wherein said mandrel stem is passing said sensors and "OFF" location signals wherein said mandrel stem is not passing said sensors.

3. The system for setting a blind rivet of claim 2, wherein said control circuit further includes circuitry to verify correct operation of said system by comparing the number of "ON" locations of said first sensor against the number of "ON" locations of said second sensor.

4. The system for setting a blind rivet of claim 1, further including an indicator operatively attached to said control circuit for signalling to an operator the correctness of the rivet set based on said comparison of said actual stem length against said predetermined desired length.

5. A system for setting a blind rivet and for evaluating the acceptability of the set, the rivet being of the type having a frangible tubular body and an elongated mandrel that includes an enlarged head and a stem extending rearwardly of the head and through said frangible tubular body, said system comprising:

an apparatus for setting a blind rivet, said apparatus including a blind rivet setting tool, said tool including a rivet pulling head for gripping and pulling said stem of said mandrel, said tool including a channel between said rivet pulling head and a point external of said tool for passage of the spent mandrel stem, a mandrel stem collection box for receiving and holding spent mandrel stems, and a collection tube connecting said blind rivet setting tool and said mandrel stem collection box such that said spent mandrel stem passes from said blind rivet setting tool to said mandrel collection box through said collection tube, said apparatus further including a sensor for sensing the bypassage of said spent mandrel stem, said sensor being adapted to produce output signals related to said bypassage of said stem; and a control circuit associated with said apparatus, said control circuit having circuitry to:

a) receive said output signals from said sensor;

b) calculate the velocity of said bypassing stem from said output signals of said sensor;

c) determine from said output signals the total time taken for said mandrel stem to pass said sensor;

d) use the velocity and said determined total time to calculate the actual length of said stem;

e) compare said actual length of said mandrel stem with a predetermined desired length.

6. The system for setting a blind rivet of claim 5, wherein said sensor is a first sensor, said system further including a second sensor for sensing said bypassage of said spent mandrel stem, said second sensor being adapted to produce output signals related to said bypassage of said stem, said second sensor being positioned downstream of said first sensor relative to the movement of said passing mandrel stem.

7. The system for setting a blind rivet of claim 6, wherein said first and second sensors are positioned on said collection tube.

8. The system for setting a blind rivet of claim 6, wherein said output signals from said first and second sensors include "ON" location signals wherein said mandrel stem is passing said sensors and "OFF" location signals wherein said mandrel stem is not passing said sensors.

9. The system for setting a blind rivet of claim 8, wherein said control circuit further includes circuitry to verify correct operation of said system by comparing the number of "ON" locations of said first sensor against the number of "ON" locations of said second sensor.

10. The system for setting a blind rivet of claim 5, further including an indicator operatively attached to said control circuit for signalling to an operator the correctness of the rivet set based on said comparison of said actual stem length against said predetermined desired length.

11. A system for setting a blind rivet and for evaluating the acceptability of the set, the rivet being of the type having a frangible tubular body and an elongated mandrel that includes an enlarged head and a stem extending rearwardly of the head and through said frangible tubular body, said system comprising:

an apparatus for setting a blind rivet, said apparatus including a channel for passage of the spent mandrel stem, said apparatus further including a sensor for sensing the bypassage of said mandrel stem, said sensor being adapted to produce output signals related to said bypassage of said stem; and a control circuit associated with said apparatus, said control circuit having circuitry to:

a) receive said output signals from said sensor;

b) calculate the actual length of said spent mandrel stem;

c) compare said actual length of said mandrel stem with a predetermined desired length.

12. The system for setting a blind rivet of claim 11, wherein said circuitry for calculating said actual length of said spent mandrel stem includes circuitry to determine from said signals from said sensor the velocity of said bypassing stem, to determine from said output signals the total time taken for said mandrel stem to pass said sensor, and to use said velocity and said determined total time to calculate said actual length of said stem.

13. The system for setting a blind rivet of claim 11, wherein said apparatus includes a blind rivet setting tool, said tool having a channel for passing said spent mandrel stem therethrough, a mandrel stem collection box for receiving and holding spent mandrel stems, and a collection tube connecting said blind rivet setting tool and said mandrel stem collection box.

14. The system for setting a blind rivet of claim 13, wherein said sensor is positioned on said collection tube.

15. The system for setting a blind rivet of claim 11, wherein said sensor is a first sensor, said system further including a second sensor for sensing said bypassage of said spent mandrel stem, said second sensor being adapted to produce output signals related to said bypassage of said stem, said second sensor being positioned downstream of said first sensor relative to the movement of said passing mandrel stem.

16. The system for setting a blind rivet of claim 15, wherein said output signals from said first and second sensors include "ON" location signals wherein said mandrel stem is passing said sensors and "OFF" location signals wherein said mandrel stem is not passing said sensors.

17. The system for setting a blind rivet of claim 16, wherein said control circuit further includes circuitry to verify correct operation of said system by comparing the number of "ON" locations of said first sensor against the number of "ON" locations of said second sensor.

18. The system for setting a blind rivet of claim 11, further including an indicator operatively attached to said control circuit for signalling to an operator the correctness of the rivet set based on said comparison of said actual stem length against said predetermined desired length.

19. A method for setting a blind rivet having a mandrel comprising a mandrel head and a mandrel stem breakable from the mandrel head and for evaluating the acceptability of the set by measuring the length of the stem once broken from the mandrel head, said method including the steps of:

setting a blind rivet in a desired position with a blind rivet setting tool having a mandrel gripping jaw assembly for gripping and pulling said mandrel and a spent stem passageway through which the stem of the mandrel passes after it is broken from the head of the mandrel, said passageway being connected to a stem collection box by a stem collection tube, said stem collection tube including a first sensor and an adjacent second sensor;

identifying and storing the first "ON" location signalled by said first sensor, said first "ON" location representing a location during which said spent stem first passes said first sensor;

identifying and storing any subsequent "ON" location during which said spent stem passes said first sensor;

identifying and storing the first "OFF" location signalled by said first sensor, said "OFF" location representing the first location during which said spent stem does not pass said first sensor;

identifying and storing the first "ON" location signalled by said second sensor, said first "ON" location representing a location during which said spent stem first passes said second sensor;

identifying and storing any subsequent "ON" location during which said spent stem passes said second sensor;

identifying and storing the first "OFF" location signalled by said second sensor, said "OFF" location representing the first location during which said spent stem does not pass said second sensor;

determining the actual velocity of said spent mandrel by measuring the time interval between said first "ON" location sensor signals produced by said first and second sensors;

determining the total "ON" time of one of said first or second sensors;

determining the actual length of said spent mandrel by multiplying said actual velocity of said stem by said total "ON" time of one of said sensors; and comparing said actual length of said spent mandrel with a predetermined desired length.

20. The method of claim 19, further including the step of confirming said actual length determination by multiplying said actual velocity of said stem by the total "ON" time of the other of said sensors.

21. The method of claim 19, further including the step of confirming the accuracy of the steps by comparing the total number of "ON" locations of said first sensor against the total number of "ON" locations of said second sensor.

22. A method for setting a blind rivet having a mandrel comprising a mandrel head and a mandrel stem breakable from the mandrel head and for evaluating the acceptability of the set by measuring the length of the stem once broken from the mandrel head, said method including the steps of:

setting a blind rivet in a desired position with a blind rivet setting apparatus, said apparatus including a passage through which the stem of a rivet mandrel passes once the rivet is set, said apparatus further including a first sensor and a second sensor, said sensors being adapted to produce output signals;

receiving in a system control circuit said output signals from said first and second sensors;

calculating the velocity of said stem from said output signals of said first and second sensors;

determining from the output signals of one of said sensors the total time taken for said mandrel stem to pass said one of said sensors;

calculating the actual stem length of said stem from said velocity and said determined total time; and comparing said determined actual stem length of said mandrel stem with a predetermined desired stem length.

23. The method of claim 22, further including the steps of identifying and storing the first "ON" location signalled by said first sensor, said first "ON" location representing a location during which said spent stem first passes said first sensor, identifying and storing any subsequent "ON" location during which said spent stem passes said first sensor, and identifying and storing the first "OFF" location signalled by said first sensor, said "OFF" location representing the first location during which said spent stem does not pass said first sensor.

24. The method of claim 23, further including the steps of identifying and storing the first "ON" location signalled by said second sensor, said first "ON" location representing a location during which said spent stem first passes said second sensor, identifying and storing any subsequent "ON" location during which said spent stem passes said second sensor, and identifying and storing the first "OFF" location signalled by said second sensor, said "OFF" location representing the first location during which said spent stem does not pass said second sensor.

25. The method of claim 24, further including the step of determining the actual velocity of said spent mandrel by measuring the time interval between said first "ON" location sensor signals produced by said first and second sensors.

26. The method of claim 25, further including the step of confirming said actual length determination by multiplying said actual velocity of said stem by the total "ON" time of the other of said sensors.

27. The method of claim 25, further including the step of confirming the accuracy of the other steps by comparing the total number of "ON" locations of said first sensor against the total number of "ON" locations of said second sensor.

28. A method for setting a blind rivet having a mandrel comprising a mandrel head and a mandrel stem breakable from the mandrel head and for evaluating the acceptability of the set by measuring the length of the stem once broken from the mandrel head, said method including the steps of:

setting a blind rivet in a desired position with a blind rivet setting apparatus, said apparatus including a passage through which the stem of a rivet mandrel passes once the rivet is set, said apparatus further including a sensor for sensing the passing of said stem, said sensor being adapted to produce output signals;

receiving in a system control circuit said output signals from said sensor;

calculating the velocity of said passing stem from said output signals;

determining from said output signals the total time taken for said mandrel stem to pass said sensor;

calculating the actual stem length of said stem from said velocity and said determined total time; and comparing said determined actual stem length of said mandrel stem with a predetermined desired stem length.

* * * * *